United States Patent [19]

Tisma

[11] Patent Number: 4,548,593

[45] Date of Patent: Oct. 22, 1985

[54] FOLDING CARTON FOR DRY POWDER

[75] Inventor: Steven Tisma, Niles, Ill.

[73] Assignee: Tisma Machine Corporation, Chicago, Ill.

[21] Appl. No.: 636,704

[22] Filed: Aug. 1, 1984

Related U.S. Application Data

[62] Division of Ser. No. 425,508, Sep. 28, 1982, Pat. No. 4,491,267.

[51] Int. Cl.[4] ..... B31B 13/14

[52] U.S. Cl. ..... 493/56; 229/17 R; 493/70; 493/72

[58] Field of Search ..... 493/56, 69, 57, 70, 493/59, 71, 72; 229/17 R, 17 G

[56] References Cited

U.S. PATENT DOCUMENTS

| | | | |
|---|---|---|---|
| 2,993,630 | 7/1961 | Cox | 229/17 G |
| 3,167,232 | 1/1965 | Partridge | 229/17 G |
| 3,481,524 | 12/1969 | Rund | 229/17 R |
| 3,722,754 | 3/1973 | Struble | 229/17 R |
| 4,015,768 | 4/1977 | McLennan | 229/17 R |

*Primary Examiner*—Leon Gilden

*Attorney, Agent, or Firm*—Laff, Whitesel, Conte & Saret

[57] ABSTRACT

The invention provides a process for making a dry powder box with greater geometrical stability and free of pin holes, gaps and the like through which powder may sift. The process uses a carton blank having a bottom closure wherein a pair of relatively large, opposing dust flaps are first folded into the carton tube, in order to define, maintain and stabilize the cross section of the carton. Then, a pair of relatively smaller, opposing major flaps are folded and glued over the open sides of the large dust flaps. This combination of flaps keeps the large flaps from working out of alignment and helps maintain the cross sectional stability of the box. The top of the carton may be a gable having panels at the ends of the gables which are slightly larger than the cross section, of the gable roof sides. When the gable is formed, the larger ends are pushed down to create a leverage which closes the top opening more securely. The cut lines which form and define the flaps extend across approximately 80° of the width of the flap, thereby leaving about 20% of the blank to form a bulk in the corner of the box. This cut line has a taper of about 15° to 40°. Thus, upon folding the flaps at both the top and the bottom, there is a small amount of bulk which must crumple together so that no pin holes are formed at a corner of the box.

7 Claims, 11 Drawing Figures

FOLDING CARTON FOR DRY POWDER

This is a division of application Ser. No. 425,508, filed Sept. 28, 1982, U.S. Pat. No. 4,491,267.

This invention relates to folding cartons and, more particularly, to folding cartons for dry powder.

There are many folding cartons for liquids, such as milk, orange juice, or the like, which are designed to meet the needs of filling, containing, and pouring liquids. These needs are often different from the needs of filling, containing, and pouring a dry powder. Each substance presents its own unique packaging needs.

Cartons for dry powder should prevent the powder from absorbing moisture, distorting the package, and sifting through openings, or between flaps. For example, if the carton originally has a square or rectangular cross section and if the contents of the box shifts, the cross section could become rhombic, thereby twisting the box and causing the bottom of the box to bow or warp. This, in turn, may possibly form a pin hole in the corner of the box, which can cause a loss of the contents.

Another consideration is the need for a carton which can be manufactured at low cost on automatic machinery. The various flaps have to be folded and glued together in a manner which reliably brings the box into its desired configuration with all pin holes closed and with all flaps glued down in a reliable manner.

Accordingly, an object of this invention is to provide new and improved cartons for dry powder. Another object is to provide cartons having both tops and bottoms which are completely closed so that there are no pin holes, warped panels, or the like, through which the enclosed dry powder may sift. Another object is to provide a carton which more reliably retains its stable shape and configuration.

Still another object is to provide dry powder cartons which are adapted to low cost manufacture on automatic machines.

In keeping with these and other objects, the invention provides a process using a carton blank having a bottom closure wherein a pair of relatively large, opposing dust flaps are first folded into the carton tube in an overlapping relationship, in order to define, maintain and stabilize the cross section of the carton. Then, a pair of relatively smaller, opposing flaps are folded and glued over the open sides of the large flaps. This combination of flaps keeps the large flaps from working out of alignment and helps maintain the cross section of the box. The top of the carton may be a gable shape having panels at the ends of the gables which are slightly larger than the cross section of the gable. Therefore, when the gable is formed, those larger ends are pushed down and towards each other to create a leverage which closes the opening more securely. The cut lines which form and define the flaps extend approximately 80% across the width of the flap, thereby leaving about 20% of the blank to form a bulk in the corner of the box. Thus, upon folding, there is a small amount of bulk which must crumple together so that no pin holes are found at a corner of the box.

A preferred embodiment is seen in the attached drawing, wherein:

FIG. 1 is a carton blank incorporating the inventive bottom and top;

FIG. 1*a* is a cross-section taken along line 1*a*—1*a* of FIG. 1, which shows how a cut is made in the blank in order to eliminate pin holes in the finished box;

FIG. 1*b* is a perspective view showing the structure of FIG. 1*a;*

Figure 1:
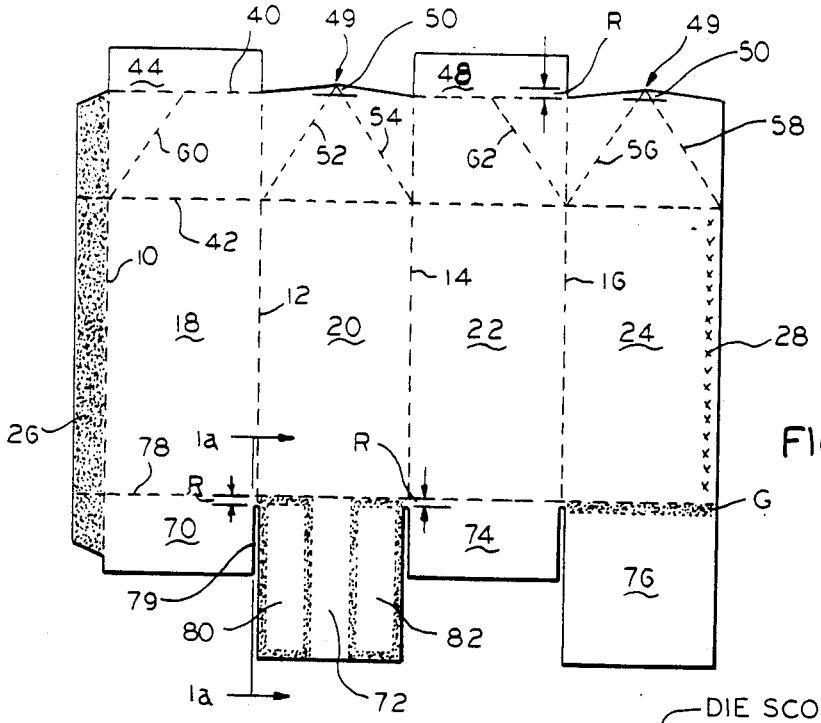

The inventive blank has score lines which are shown by dot-dashed lines and cut lines which are shown by solid lines. The four vertical score lines 10, 12, 14, 16 (FIG. 1) define four vertical panels 18, 20, 22, 24, which fold to form a rectangular tube, held in place by a glue flap 26 secured to panel 24, under the "X" marks 28. The upper edge of the blank has two spaced parallel score lines 40, 42 which define panels that tuck-in to form a gable top. The gable is formed as the flaps fold together along the triangular lines 52, 54, 56, and 58. The upper gable ridge flaps 44, 48 are then glued together to form the top edge of the gable. The diagonal score lines 60, 62 enable a gable end to be pulled out to form a pour spout, when the carton is opened.

Depending from the bottoms of the tube panels are four end flaps 70, 72, 74, 76, the top and folding edges of which are defined by a score line 78. The relatively large and opposed bottom end flaps 72, 76 are dust flaps which tuck-in first. They have a size and shape that conforms to the desired cross section of the tube. The relatively small and opposed end flaps 70, 74 are major flaps which fold over the open edges of and glue to the dust flaps 72, 74 in order to seal and stabilize them. Each of the major flaps 70, 74 has a size and shape which corresponds to less than one-half of the cross section of the tube (See FIG. 5).

Figure 1A:
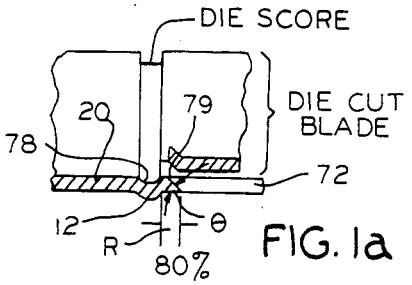

FIG. 1*a* defines the cut lines 79 which forms a flap (such as 72) top or bottom. This figure shows a small segment or part of the total flap width extending along line 78. In FIG. 1*a*, the die cut blade cuts the diagonal line 79 extending transversely and obliquely across the thickness of the cardboard stock at the root end of the cut. The cutting edge of the blade is identified by cross-hatching to indicate how the edge is beveled and sharpened. The diagonal line 79 leaves 80% uncut on one side of the blank with bulk relief on the other side of the blank. The angle $\theta$ of line 79 is preferably in the range of 15°–40° (for cardboard stock up to 0.025-inch thickness). The angle $\theta$ changes as the thickness of the cardboard stock increases. The relatively narrow uncut part of the flap which remains at the root end (shown as "R" on both top and bottom) is approximately equal to the board thickness. When the flaps are folded, there is a small amount of bulk carton material at the root end of each cut line. The bulk material bunches, scrunches up and wedges itself together in order to close any pin hole which might otherwise remain at a corner of the box.

When the bottom flaps are folded, dust flap 76 folds first (FIG. 2) and then dust flap 72 folds second into the tube formed by the panels 18, 20, 22, 24. Some glue G is preferably spread between the flaps 72, 76 so that they are joined near one end. These overlying dust flaps fix the cross sectional dimensions of the tube. Obviously, there is no room for any powder to sift out of the box along the score line 78 (FIG. 1) which define the folded edge of each of the dust flaps 72, 76.

Figure 2:
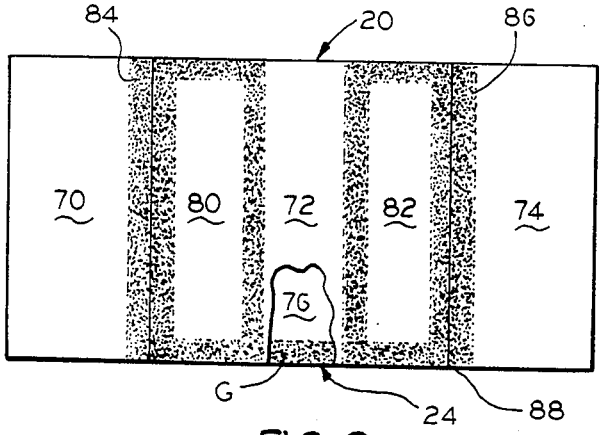
FIG. 2 is a plan view of the bottom of the box just prior to its closure, showing the gluing pattern for the bottom.

Initially, the two major flaps 70, 74 fold to extend horizontally and outwardly, as seen in FIG. 2. Then, the flaps pass over a glue gun or roller, which distributes glue in the two areas 80, 82 (FIG. 2) on the outer dust flap 72, which will be directly under the two major flaps 70, 74. Some glue is also formed in beads 84, 86 extending along the inner edges of the major flaps 70, 74. The folded edges 78, 78 on the major flaps 70, 74 are also closed so that the dry powder cannot sift out of them. Therefore, the only remaining place where powder could possibly escape would be from pin holes formed at the corners of the box (as at 88, FIG. 2). These pin holes are closed by the excessive bulk of the blank material, in the area shown at "R" (FIG. 1).

Figure 3:
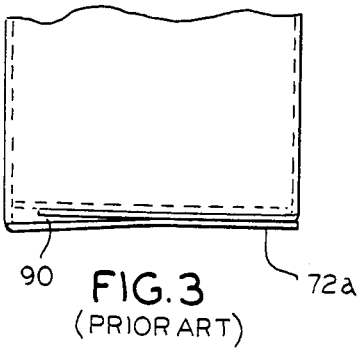
FIG. 3 (PRIOR ART)
FIGS. 3 and 4 show the bottom of prior art boxes in order to explain some of the problems which have occurred in the past.

One of the problems which was encountered in the past was that, very often, a large end flap on the outside of the box was misaligned, warped or gapped at some point. For example, FIG. 3 shows a large flap 72*a* on the outside of the bottom and a poorly folded and glued place at 90, which forms an open gap. Of course, the gap 90 is an unwanted defect and therefore it is not possible to say that it will always appear at either the particular place identified by the Number 90 or any other given place. Rather, the outside bottom panel could warp any place.

Figure 5:
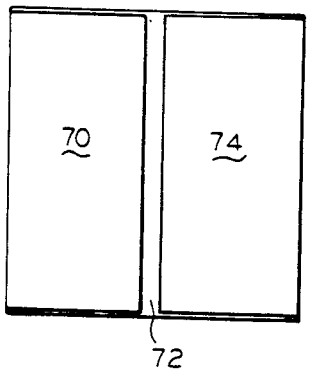
FIG. 5 shows the bottom of the inventive box and helps to explain how the problems seen in FIGS. 4 and 5 are overcome.

In the inventive box, this problem does not occur because the interior dust flaps 72, 76 are large enough to stabilize the interior dimensions within the tube and these flaps, in turn, are stabilized by the cross section of the tube. Automatic box making machinery can control the folding and gluing of the smaller flaps 70, 74 much easier than it can control the folding and the gluing of the larger flaps 72, 76. Moreover, as seen in FIG. 5, the free ends of the smaller flaps 70, 74 do not come into direct contact with each other. Therefore, they do not interfere with each other during the gluing.

Figure 4:
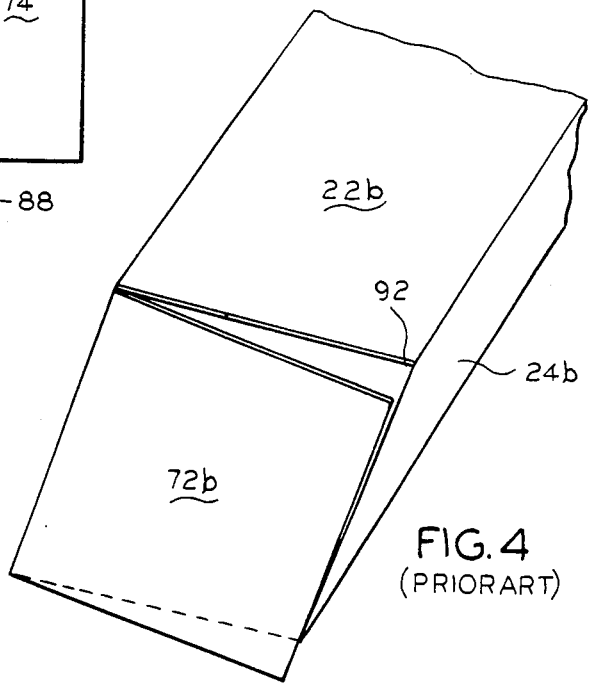
FIG. 4 (PRIOR ART)
Figure 1B:
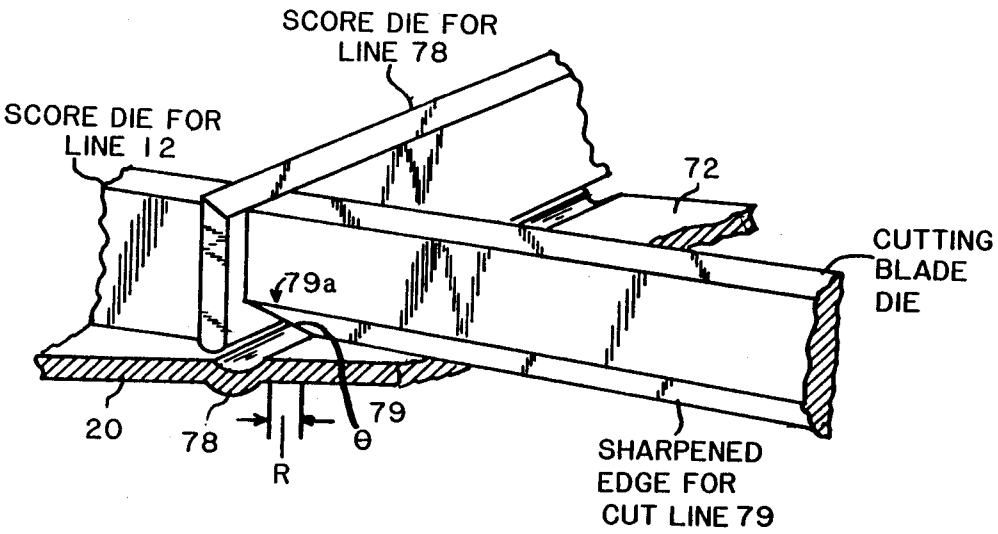

Another problem encountered on the prior art is seen in FIG. 4 where the cross section of the tube of the box has been squeezed from a square or a rectangle to a rhomboid, with a resultant twist of the box tube. This could have occurred when the large flap 72*b* was glued into place, or because the load within the box shifted.

In this example of FIG. 4, a pin hole or gap might likely appear in a corner, as at 92. The inventive box does not experience such distortions because the configuration of the two dust flaps 72, 76 exactly conform to the desired cross section of the box, and therefore, they more or less brace the tube against the dimensional change.

Figure 6:
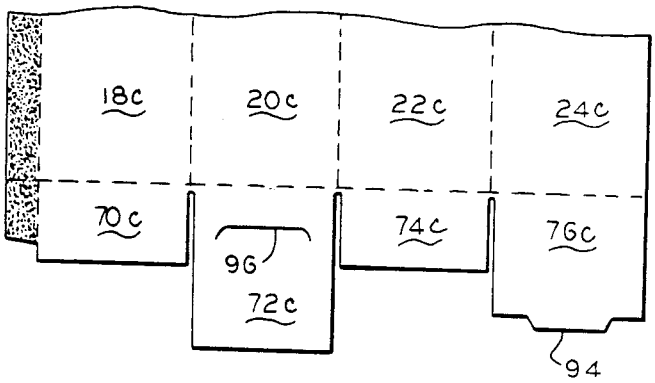
FIG. 6 shows the bottom of an alternative blank with a locking tube.

An alternative bottom flap arrangement for the blank is seen in FIG. 6 where a first of the dust flaps 76*c* ends in a tab 94 which fits into a locking slot 96 formed in the opposing dust flap 72*c*. The tab 94 and slot 96 may also take other forms, which are suitable for interlocking the dust flaps. The major outside flaps 70*c*, 74*c* function the same as the major outside flaps 70, 74 in FIG. 1.

Figure 7:
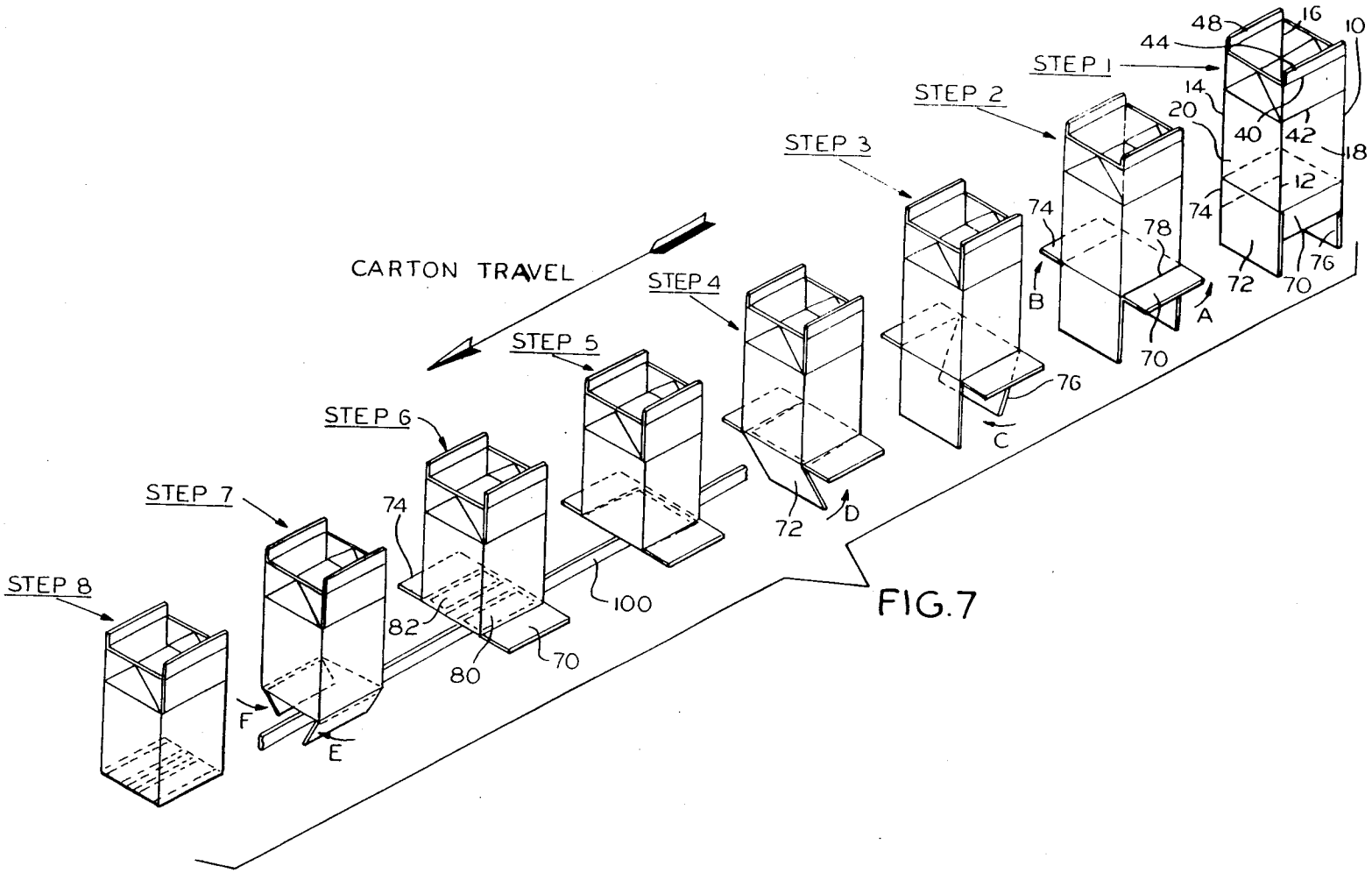
FIG. 7 is a progression series of eight stop motion views showing how panels and flaps are folded and glued to form the bottom of the inventive box.

Manufacturing process steps for folding and gluing the bottom of the blank are seen in FIG. 7. First, in order to form the tube, the blank is folded by 90° at each of the score lines 10, 12, 14, 16 and glue flap 26 (FIG. 1) is glued under the edge 28. At this time, all of the bottom flaps 70, 72, 74, 76 are hanging straight down, as shown in Step 1 (FIG. 7).

In Step 2, the major flaps 70, 74 are folded (in directions A, B) along score line 78, to flare outwardly in a horizontal direction.

In Step 3, any suitable means (not shown) tucks the trailing dust flap 76 (in direction C) into the tube and a bead of glue G (FIGS. 1, 2) is distributed on the outside of flap 76 (i.e. on the underside of flap 76, when it reaches its final position).

In Step 4, the dust flap 72 encounters an automatic machine, having a retaining rail 100 which pushes flap 72 in direction D, to tuck-in against the underside of dust flap 76, where it is held by glue bead G. Also, in Step 5, any suitable means (such as a glue gun or roller, not shown) applies glue to the undersides of flaps 70, 72 and 74, in the pattern of FIG. 2. Two fields 80, 82 of glue are formed on flap 72 and two beads 84, 86 of glue are formed on major flaps 70, 74. The glue pattern could also be reversed so that the glue beads 84, 86 appear on dust flap 72 while the two fields of glue 80, 82 appear on the major flaps 70, 74.

In Step 6, the major flaps 70, 74 are released from their extended horizontal position, while the retaining rail 100 holds the dust flap 72 in place. In Step 7, the major flaps 70, 74 are folded in directions E, F, to points where they lock in and seal against the dust flap 72. In Step 8, the bottom of the box is held under compression for a period which is long enough for the glue to set and firmly hold the bottom flaps in place.

Figure 8:
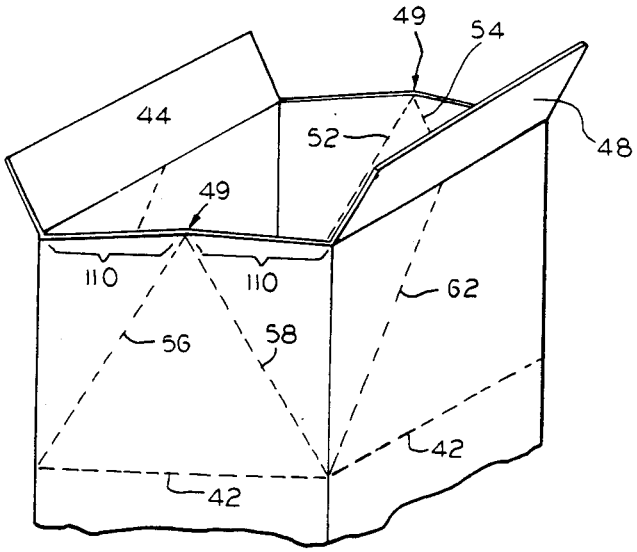
FIG. 8 is a perspective view of the top of the box prior to being folded into a gable configuration.

The novel features of the top are best explained by reference to FIGS. 1, 8 and 9. By way of background, one may refer to U.S. Pat. No. 2,993,630 (Cox, et al) and note that it includes flaps 50, 51 at the tops of panels which are used for forming the ends of the gables. If Cox, et al's. FIG. 3 is examined, a small pin hole is clearly seen, and the physical folded box would almost certainly have the same hole. According to the present invention, the upper flaps (50, 51 in Cox et al) are eliminated on the panels at the ends of the gable (i.e., at the tops of the panels 20, 24). The centers 49 (FIG. 1) on the upper edges of these panels are raised to a peak, by a distance 50 (about 1/16 inch in one case).

Figure 9:
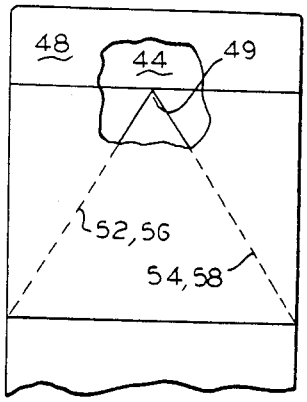
FIG. 9 is a plan view of a folded and completed box top, taken along line 9—9 of FIG. 8, which shows how pressure is applied to the top in order to better seal it.

As seen in FIG. 9, upon folding the gabled top, the score lines 56, 58, on one gable end, come to lie in alignment with each other along one diagonal of the gable and the score lines 52, 54 come to lie in alignment along a diagonal at an opposing end of the gable. The points 49 at the tops of these score lines approach and touch each other at the longitudinal centers of the two upstanding glue flaps 44, 48, which form the ridge at the top of the gable. When the two glue flaps 44, 48 are glued together, the folded peaks 49, 49 should not raise high enough to become captured between flaps 44, 48. On the other hand, the compression force holding together the glued flaps 44, 48 should push downwardly at 49 (FIG. 9) upon the folded peaks to hold them in compression. The pressure acting downwardly at 49 is enough to press together a small bulk of the carton stock of the blank and seal all pinholes.

Ideally, there is enough glue between ridge flaps 44, 48 so that, when they are compressed together, the adjacent edges 110 of the gable ends are wetted with enough glue to seal them but not with enough glue to prevent the edges 110 from folding out to form a pour spout.

FIG. 7 shows a continuous operation wherein each of the eight steps is done while the folding carton moves smoothly, in an uninterrupted flow through a box set, form and fill machine of a production line. The prior art required the box to move intermittently, stopping at work stations representing some of the eight steps. That is, in the prior art the blank had to stop at first position which corresponds to step 2 (FIG. 7) and at a second position which corresponds to step 8 (FIG. 7). This intermittent motion of the blank causes the box to be made is a slower manner, as compared to the manufacturing speed of the inventive box. This increase of speed occurs owing to the geometric form of the bottom flaps and the sequence of flap flap closings.

The widths of the blank panels and flaps may be changed to give other cross-sectional configurations which become more rectangular. Everything else in a box with a rectangular cross-section remains the same, except for the panel widths.

The advantages of the inventive bottom and top are that a dry powder may be contained and held more securely, with less risk of sifting of particles through pin holes. The superior containment is also of value to protect the surroundings of the box. For example, if a box of sugar leaks, there is not only a loss of the sugar, but also a greater damage to the shelf under the sugar box. The leaking sugar becomes sticky and may destroy the paint or varnish. Also, adjacent items on the shelf may become covered with the sticky syrup.

Those who are skilled in the art will readily perceive how to modify the invention. Therefore, the appended claims are to be construed to cover all equivalent structures which fall within the true scope and spirit of the invention.

What is claimed is:

1. A process for forming a dry powder box comprising the steps of:

(a) forming a blank having a surface with a plurality of spaced parallel score lines extending across said surface to enable it to fold to form a plurality of panels that come together to form a tube, the bottoms of a first pair of opposing panels of said tube having dependent therefrom a pair of relatively large dust flaps formed by cut lines which leave a small and controlled amount of bulk at the root of the cut, each of said dust flaps having a configuration conforming to the cross section of said tube, the bottoms of a second pair of opposing panels of said tube having dependent therefrom a pair of major flaps, each of said major flaps having a configuration extending over the entire width of and less than half of the length of the cross section of said tube;

(b) forming said flaps by said cut line extending across most of the width of said flap, the root of said cut line beginning with a taper in the thickness of the blank of about 15° to 40°, with respect to said surface;

(c) folding said dust flaps into said tube to occupy and stabilize the cross section of the tube, said bulk being scrunched up by said folding to fill any pin holes which might otherwise remain at the roots of the cut lines, said folded dust flaps overlying each other with at least a bead of glue between them; and (d) folding said major flaps over said overlying dust flaps, with fields of glue distributed between the major flaps and their confronting dust flap.

2. The process of claim 1 wherein said step (a) comprises the further step of forming said blank with panels for forming a gabled top having two ends, two sides, and two glue flaps attached to said two sides, one opposing pair of said tube panels having said gable end panels with an upper edge that rises near its center to an elevated point, a second opposing pair of said tube panels having said side panels with said attached glue flaps which come together to form a ridge on said gable, the elevated point near said center rising high enough to be compressed by said ridge forming glue flaps but not high enough to be captured between said ridge flaps.

3. The process of claim 2 wherein said top and bottom flaps are formed by cut lines extending across most, but not all, of the way across said flaps whereby a small and controlled amount of bulk of the material forming said blank remains to be folded into corners in order to block pin holes in said corners.

4. The process of claim 1 wherein step (b) further comprises initially folding said major panels out to a horizontal position after said dust panels are folded in and applying glue over said bottom to provide said fields of glue.

5. The process of claim 1 wherein one of said dust flaps has a locking tab and the other of said dust flaps has a slot for interlockingly receiving said locking tab.

6. The process of claim 1 and the added step of forming said box by a smooth and uninterrupted flow of said blank through a box set, form and fill machine.

7. The process of claim 1 and the added step of forming said flaps by cut lines extending across approximately 80% of the width of said flap, said cut line being cut with a taper of about 15° to 40°.

* * * * *